United States Patent [19]

Burns et al.

[11] Patent Number: 4,469,027

[45] Date of Patent: Sep. 4, 1984

[54] ARMOR PIERCING AMMUNITION HAVING INTERLOCKING MEANS

[75] Inventors: Bruce Burns, Churchville; William Donovan, Aberdeen, both of Md.

[73] Assignee: The United States of America as represented by the Secretary of the Army, Washington, D.C.

[21] Appl. No.: 485,344

[22] Filed: Apr. 15, 1983

[51] Int. Cl.[3] ..... F42B 13/16

[52] U.S. Cl. ..... 102/521

[58] Field of Search ..... 102/520–523, 102/529, 703

[56] References Cited

U.S. PATENT DOCUMENTS

| | | | |
|---|---|---|---|
| 3,359,905 | 12/1967 | Engel | 102/522 |
| 3,859,922 | 1/1975 | Kaplan et al. | 102/521 |
| 4,029,018 | 6/1977 | Bjornson | 102/521 |

*Primary Examiner*—Harold J. Tudor
*Assistant Examiner*—Tyrone Davis
*Attorney, Agent, or Firm*—Robert P. Gibson; Anthony T. Lane; Harold H. Card, Jr.

[57] ABSTRACT

An ammunition round for an artillery gun comprises, as an armor piercing round, an outer tubular disposable sabot and an inner projectile which are joined by interlocking means to join them until exiting from the gun muzzle and separates them in ballistic flight. The interlocking means comprises left-handed threads and right-handed threads; both directions of threads being on both the inner wall of the sabot and the outer wall of the projectile. In one embodiment the two directions of threads are on axially tandem sections and in another embodiment they are on the same section, to form a herringbone pattern with raised diamond-shaped protrusions.

6 Claims, 3 Drawing Figures

ARMOR PIERCING AMMUNITION HAVING INTERLOCKING MEANS

BACKGROUND OF THE INVENTION

The design of rounds of ammunition used by artillery guns have evolved over the years to take advantage of improvements in guns and to be able to defeat the defense targets. Improvements in the designs of tank armor have called for new types of ammunition capable of penetrating and defeating such armor. For example, the HEAT (high-explosive anti-tank) shaped charge round, containing an internal explosive charge, was developed specifically as an armor piercing projectile. A more recent example is "AP shot" (armor piercing shot) in which, in one type, the ammunition round may be a high-carbon alloy steel projectile, without an explosive charge or fuse. A similar projectile is "HVAP", which is a projectile having a hard core of tungsten carbide or similar material.

A relatively recent high-velocity armor piercing ammunition is a "sabot-projectile" which consists of an outer tubular expendable discarding sabot and an inner subcaliber solid metal projectile. The sabot-projectile, when fired from the artillery gun, presents a large cross-sectional area to obtain high muzzle exit velocity for ballistic flight. The projectile, in free flight and freed from its sabot, has relatively less velocity retardation caused by air drag, etc., since its diameter is less than that of the combined sabot-projectile.

In the sabot-projectile type of ammunition round, the interlocking connection between the sabot and the projectile mu keep them together before the gun is fired, i.e., while being transported, etc., and also while in the gun bore. However, they must separate while in ballistic flight. It has been suggested that grooves, which may be axially aligned or at an angle to the axis, may be used on the external wall of the projectile or the internal wall of the sabot, or both, and elongated projections on the opposite member may fit in such grooves. Some types of sabot-projectiles have used a single direction interlocking thread and other types have used frictional engagement, i.e., the smooth outer wall of the projectile frictional fits the smooth inner wall of the sabot.

When the sabot-projectile uses a frictional fit interlock, the frictional characterization of the interlock may change with storage or in adverse environments. For example, the non-metallic parts may absorb moisture (hygroscopic distortion) or the metal parts may oxidize. The use of interlocking grooves may require special and expensive metal working. The use of a single helical thread, although relatively low in manufacturing cost, may present an unequal loading by overloading the forward end and may permit rotary slip between the sabot and projectile before they exit the gun barrel.

Objectives and Features of the Invention

It is an objective of the present invention to provide an artillery armor piercing ammunition round which, by combining an outer sabot and an internal projectile, provides a relatively large diameter while in the gun bore and a small diameter while in ballistic flight, after separation of the sabot from the projectile, and which maintains an accurate axial and rotary alignment and transmission of the peripheral force on the sabot to the projectile while they are interlocked.

It is a further objective of the present invention to provide such an artillery ammunition round in which the interlocking means between the sabot and the projectile is sufficiently secure so that they do not separate while in the gun bore and yet arranged so that they are certain to separate after leaving the gun bore and while in ballistic flight.

It is a further objective of the present invention to provide such an artillery ammunition round in which there is a relatively even distribution of the load over the entire mechanical interlocking elements to avoid overloading any of its sections and an even distribution of the locking and unlocking torque over the driving elements of the sabot.

It is a further feature of the present invention to provide such an artillery ammunition round in which the interlocking means may be economically manufactured at high rates of production.

It is a feature of the present invention to provide an ammunition round, which may be an armor-piercing round, adapted to be propelled into ballistic flight by being discharged from an artillery gun bore. The round includes a tubular outer disposable sabot. The sabot has, on its inner wall (its bore wall) both right-handed and left-handed threads. The threads are inwardly protruding helical threads and may be arranged, in one embodiment, in axially tandem sections. In another embodiment the threads are located in the same section to form a cross-hatched herringbone pattern with diamond-shaped protrusions.

An elongated solid projectile is adapted to fit inside the sabot during the discharge and be separated from the sabot during flight. The projectile has, on its exterior wall, both right-handed threads and left-handed threads (both outwardly protruding helical threads) which removably intermesh with the respective right and left-handed threads on the sabot.

BRIEF DESCRIPTION OF THE DRAWINGS

Other objectives and features of the present invention will be apparent from the following detailed description which should be taken in conjunction with the accompanying drawings In the drawings.

DETAILED DESCRIPTION OF THE INVENTION

The sabot-projectile ammunition round consists generally of a projectile 10 which is removably interlocked with a sabot 15.

Figure 1:
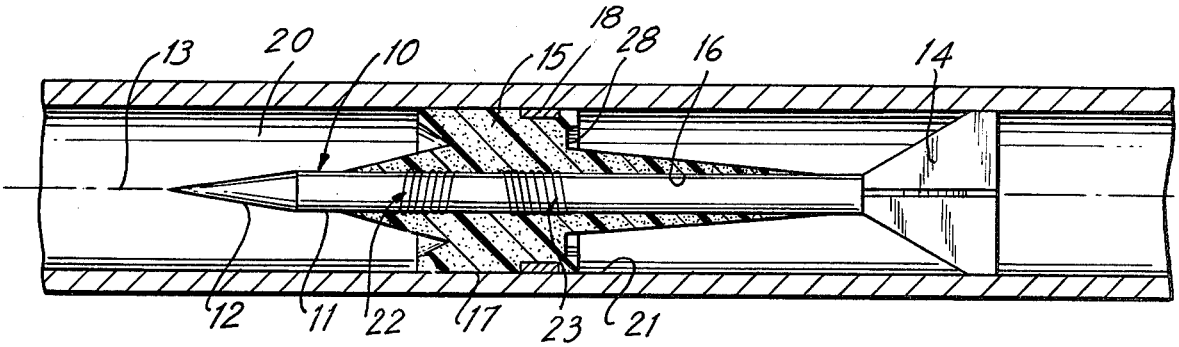
FIG. 1 is a cross-sectional view of the sabot-projectile ammunition round positioned in the bore of an artillery gun barrel.
Figure 2:
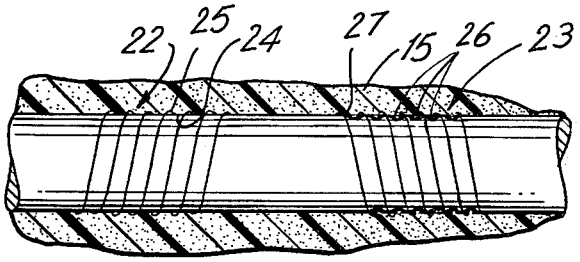
FIG. 2 is an enlarged front plan view of a portion of the inner wall of the sabot showing the arrangements of the interlocking means in the first embodiment of the present invention.
Figure 3:
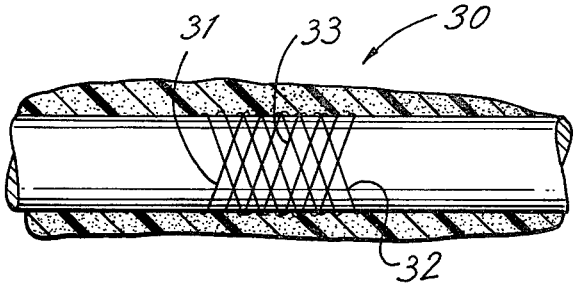
FIG. 3 is an enlarged front plan view of a portion of the inner wall of the sabot showing the arrangements of the interlocking means in the second embodiment of the present invention.

In the embodiment illustrated in FIGS. 1-3, the sabot projectile round is shown as being an armor piercing fin stabilized projectile. However, it will be understood that the present invention, which relates to the interlocking means which removably locks the sabot into the projectile, may be used in other types of ammunition rounds.

As shown in FIG. 1, the projectile 10 includes an elongated cylindrical body 11 having a constant diameter along its length and round in cross-section. The projectile 10 has an integral pointed nose section 12. Its imaginary central axis coincides with the imaginary central axis 13 of the artillery gun bore 20. A set of fins 14 is connected to the solid body portion 11 of the projectile 10. The fins help to stabilize the projectile while it is in ballistic flight. Preferably, the projectile is made of a hard metal alloy which is adapted to pierce an armor plate. For example, it may be a steel metal alloy or a tungsten carbide composition.

A disposable sabot 15 is removably interlocked with the projectile 10. The sabot 15 is a conventional multi-segmented (axially split) discarding sabot having an internal bore 16 within which the projectile 10 is positioned. The outer diameter of the sabot, which is uniform in cross-section in its central section, forms an outer tubular wall 17 which contains a conventional obturator 18 and rides along the inner wall 21 of the gun barrel.

In the first embodiment of the present invention, as illustrated in FIGS. 1 and 2, the intermeshing means are divided into two axially tandem sections 22 and 23 which are aligned along the imaginary axis 13. The front section 22, which is closer to the nose 12, has meshed left-handed helical threads. The left-handed helical threads, which are inwardly directed protrusions 24 on the sabot 15, mesh with the outwardly directed corresponding protrusions 25 forming left-handed helical threads on the projectile 10. Similarly, the inwardly protruding right-handed helical threads 26 of the sabot 15 intermesh with the outwardly protruding right-handed helical threads 27 of the projectile 10. Although in FIG. 1 the front section (first section) has left-handed threads and the rear section (second section) has right-handed threads, it will be understood that the order may be reversed so that the front section would have right-handed threads and the rear section would have left-handed threads. When the gun is fired, gas pressure within the gun tube spreads across the entire transverse diametral plane 28 of the sabot. Since the sabot 15 and projectile 10 are interlocked, they acquire an identical velocity and, in the case of a rifled gun tube, an identical projectile spin.

The design of the threads depends upon the types of materials used on the inner wall of the sabot and the outer wall of the projectile and the stresses and loads to be applied during firing and while in ballistic flight. The helical threads may utilize conventional thread design criteria such as matching V-groove threads, buttress threads, "V" threads and other types of conventional threads, the names referring to different shapes of the thread designs as seen in cross-section. Alternatively, special thread designs may be used. The pitch of the helical threads may be selected to be adapted to the properties of the materials used in the interlocking connection. The pitch of the threads, the number of threads and the type of thread design (cross-sectional shape) may be selected so that they are either uniform in the front section and the rear section or alternatively they may differ. The use of different thread designs or different numbers of threads is particularly useful when the load to be transmitted from the sabot to the projectile is desired to be unevenly divided between the two sections, for example, because of the design of the sabot.

An alternative design, utilized in the second embodiment of the present invention, is shown in FIG. 3. FIG. 3 is an enlarged view of the internal wall of the sabot and shows the single section 30 having left-handed screw threads 31 and right-handed screw threads 32. The left-handed screw threads 31 cross with the right-handed screw threads 32 to form a herringbone pattern having helically aligned diamond-shaped protrusions 33. The pattern of the screw threads on the projectile is the same. The projectile also has crossed left-handed screw threads and right-handed screw threads forming a herringbone pattern which interlocks with the herringbone pattern on the internal wall of the sabot.

In both embodiments the oppositely directed threads automatically provide axial alignment. There will be exact meshing at some peripheral locations. Consequently, no one point will be subject to catastrophic overloading. The torque transmission for the sabot to the projectile is uniform and reliable because the torque force (about the axis) is translated simultaneously to all the teeth of the threads. The thread teeth accept the peripheral (about the axis) component of the load on the flanks of the teeth, which, since they are in bearing contact, transmit the load evenly to the projectile, i.e., the driven member.

We claim:

1. An ammunition round adapted to be propelled into ballistic flight when discharged from an artillery gun bore comprising:

a tubular outer sabot having on the inner tubular wall inwardly protruding helical threads which are both right-handed threads and left-handed threads;

an elongated projectile removably interlocked into said sabot during said discharge and adapted to be separated therefrom during said flight, the projectile having on its exterior wall outwardly protruding helical threads which are both right-handed threads and left-handed threads, which threads are removably intermeshed with the said respective right and left threads on the sabot.

2. An ammunition round as in claim 1 wherein said right-handed threads and said left-handed threads on said projectile and said sabot are on different and axially tandem sections of said sabot and projectile.

3. An ammunition round as in claim 2 wherein the diameters of each of the right-handed threads are uniform and the diameters of each of the left-handed threads are uniform and the two said diameters are different.

4. An ammunition round as in claim 2 wherein the diameters of each of the left-handed threads are uniform and the two said diameters are different.

5. An ammunition round as in claim 1 wherein the said right-handed threads and the said left-handed threads on both the sabot and the projectile are on the same axial section and both the respective said sabot and projectile threads overlap to form a herringbone pattern having diamond-shaped protrusions.

6. An ammunition round adapted to be propelled into ballistic flight when discharged from an artillery gun bore comprising:

an elongated tubular outer sabot having on the inner tubular wall inwardly protruding helical threads which, in its axially aligned first section, are right-handed threads and in its axially aligned section in tandem with said first section are left-handed threads;

an elongated projectile removably interlocked into said sabot during said discharge and adapted to be separated therefrom during said flight, the projectile having on its exterior wall outwardly protruding helical threads which are both right-handed threads and left-handed threads, which threads are removably intermeshed with the said respective right and left threads on the sabot.

* * * * *